US006766774B1

(12) United States Patent
Kussmann

(10) Patent No.: US 6,766,774 B1
(45) Date of Patent: Jul. 27, 2004

(54) COOLING MODULE WITH AXIAL BLOWER AND PRESSURE REGULATED CROSS-FLOW FAN

(75) Inventor: Ingo Kussmann, Ingelheim (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/464,300

(22) Filed: Jun. 18, 2003

(51) Int. Cl.[7] ..... F01P 5/02

(52) U.S. Cl. ..... 123/41.48; 123/41.12; 123/41.49

(58) Field of Search ..... 123/41.48, 41.49, 123/41.04, 41.05, 41.06, 41.11, 41.12

(56) References Cited

U.S. PATENT DOCUMENTS 4,186,693 A * 2/1980 Thien et al. ..... 123/41.12
4,651,922 A * 3/1987 Noba ..... 236/35
4,765,284 A * 8/1988 Kanazawa et al. ..... 123/41.49
5,065,814 A * 11/1991 Loeber et al. ..... 165/41
6,070,560 A * 6/2000 Johnston et al. ..... 123/41.11
6,189,492 B1 * 2/2001 Brown ..... 123/41.49
6,223,807 B1 * 5/2001 Asche et al. ..... 165/43
6,439,172 B1 * 8/2002 McGovern et al. ..... 123/41.48

* cited by examiner

*Primary Examiner*—Marguerite McMahon
(74) *Attorney, Agent, or Firm*—Cary W. Brooks; Linda M. Deschere

(57) ABSTRACT

A cooling unit includes a radiator and an axial flow blower that draws air through the radiator along a longitudinal axis and a cross-flow fan that draws air along a lateral axis. The cross-flow fan forces air through the radiator along the longitudinal axis. The axial flow fan draws air through the radiator long the longitudinal axis. A moveable baffle is operable to selectively block air flow from the cross-flow fan.

20 Claims, 1 Drawing Sheet

COOLING MODULE WITH AXIAL BLOWER AND PRESSURE REGULATED CROSS-FLOW FAN

FIELD OF THE INVENTION

The present invention relates to engine cooling and more particularly to an improved cooling unit for an engine.

BACKGROUND OF THE INVENTION

Vehicular engines, whether internal combustion or fuel cell based, generate heat during the energy conversion process, which heats up the components of the engine. In some instances, this heat can damage or significantly wear the engine components. A cooling circuit is provided to avoid excessive heating of the engine components.

The cooling circuit circulates a flow of cooling fluid through the engine and a radiator. The cooling fluid is in heat exchange relationship with the components of the engine. Heat is transferred from the engine to the cooling fluid. The cooling fluid flows from the engine and through a radiator. The radiator acts as a heat exchanger enabling heat transfer from the cooling fluid to atmosphere. In this manner, the cooling fluid is continuously warmed by the engine and cooled by the radiator to reduce engine temperature.

Air flow through the radiator draws heat from the atmosphere immediately surrounding the radiator. This air flow is necessary to enable the radiator to sufficiently transfer heat from the cooling fluid. During periods of vehicle movement, natural air flow is induced. That is to say, as the vehicle moves forward, air naturally flows through the vehicle. This natural air flow increases or decreases corresponding to vehicle speed. At higher speeds, the natural air flow draws sufficient heat from the radiator. However, during periods of rest or driving at lower speeds there is insufficient natural air flow through the radiator.

Traditional vehicle cooling units include either an axial blower positioned in front of the radiator, an axial blower positioned behind the radiator or both. The axial blower positioned in front of the radiator is operable to blow air through the radiator. The axial blower positioned behind the radiator is operable to draw air through the radiator. During periods when the natural air flow is too light to sufficiently draw heat from the radiator, the axial blower or blowers are activated to induce air flow through the radiator.

Such traditional systems retain specific disadvantages. In the case of a single axial blower positioned behind the radiator, the air flow induced by the single blower may be insufficient. In the case of an axial blower positioned in front of the radiator, the axial blower itself may block significant amount of natural air flow induced by vehicle motion. As a result, the axial blower(s) are frequently switched on to compensate for the lack of natural air flow through the radiator. The frequent operation of the axial blower(s) is inefficient and increases wear of the axial blower(s).

SUMMARY OF THE INVENTION

The present invention provides a cooling unit including a radiator. The cooling unit further includes a blower that draws air through the radiator along a longitudinal axis and a cross-flow fan that draws air along a lateral axis. The cross-flow fan forces air through the radiator along the longitudinal axis.

In one feature, the cross-flow fan includes a flap that is movable between an open position to enable air flow from the cross-flow fan and a closed position to block air flow from the cross-flow fan. A biasing member biases the flap in the open position. Further, when the flap is in the closed position the cross-flow fan stops operating.

In another feature, when in the open position the flap partially blocks natural air flow into the radiator.

In yet another feature, an intake extends along the lateral axis and functions to draw air through the cross-flow fan.

In still another feature, air forced through the radiator and air drawn through the radiator along the longitudinal axis cools a fluid flowing through the radiator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
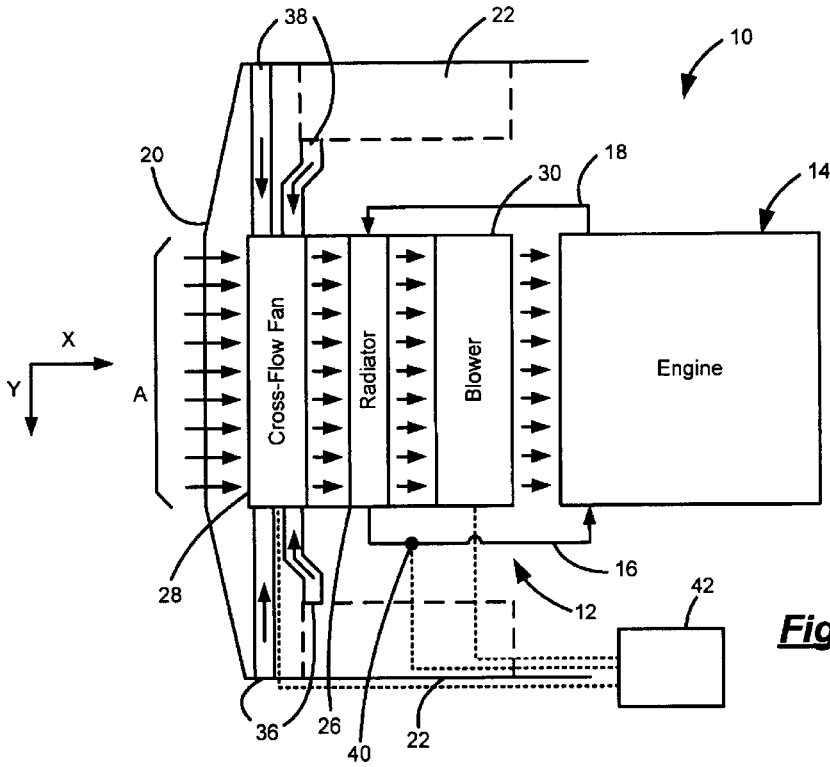
FIG. 1 is a functional block diagram of a vehicle having a cooling unit including a cross-flow fan.
Figure 2:
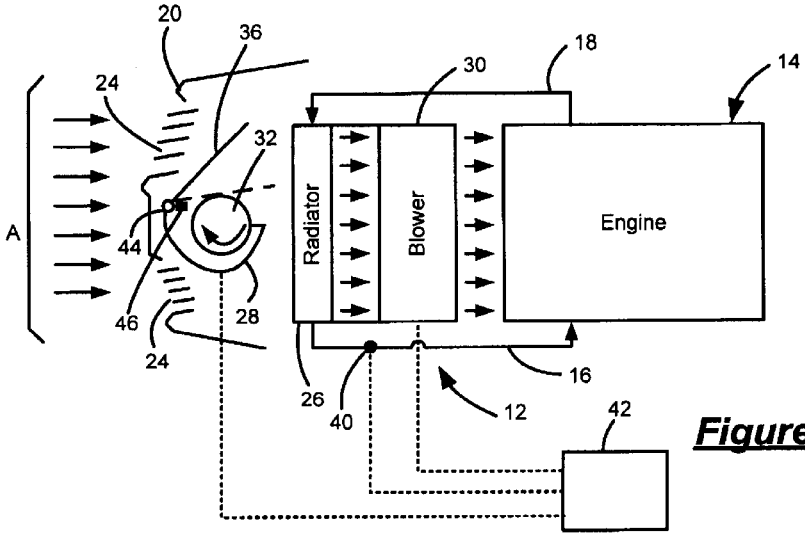
FIG. 2 is a side view of the functional block diagram of FIG. 1.

Referring now to FIGS. 1 and 2, a vehicle 10 is shown including a cooling unit 12 and an engine 14. As used herein engine 14 used in a broad sense to include any energy conversion device including an internal combustion engine, a fuel cell engine or other types of energy conversion devices capable of powering a vehicle. A cooling fluid (not shown) circulates between the engine 14 and the cooling unit 12. The cooling fluid flows into the engine 14 through a conduit 16 and is in heat exchange relationship with components of the engine 14. Heat transfer occurs from the engine 14 to the cooling fluid, thereby heating the cooling fluid and cooling the engine 14. The heated cooling fluid flows through a conduit 18 from the engine 14 to the cooling unit 12. Traditionally, a pump (not shown) is provided and is driven by the engine 14 to induce circulation of the cooling fluid between the engine 14 and the cooling unit 12. In addition, a thermostatic value (not shown) may be utilized to selection control flow of the cooling fluid.

The vehicle 10 also includes a front fascia 20 and wheel wells 22 disposed on either side. The wheel wells 22 house wheels (not shown) that are driven by the engine 14 in the case of a front wheel drive FWD vehicle. The front fascia 20 includes a plurality of vents 24 formed therethrough. The fascia 20 protects the engine 14 and cooling unit 12 while enabling air flow through the vents 24. Forward driving motion of the vehicle 10 induces air flow indicated by the arrows labeled A through the vents 24 and into the cooling unit 12. This natural air flow cools the cooling fluid flowing through the cooling unit 12 so that it may circulate back to the engine 14 to further cool the engine 14.

According to the present invention, the cooling unit 12 includes a radiator 26, a cross-flow fan 28 and an axial blower 30. The radiator 26 is in fluid communication with the engine 14 through the conduits 16,18. The radiator 26 is a heat exchanger that cools the cooling fluid circulated therethrough. The cooling fluid re-circulates back to the engine 14 to further cool the engine 14. The radiator 26 is a conventional lined tube heat exchanger that includes air flow passages (not shown) and fins (not shown) through which air flows in tubes which carries the cooling fluid. Heat radiates from the radiator 26 to cool the cooling fluid circulating therein. The radiated heat is drawn away from the radiator 26 by the air flow.

Occasionally, there is insufficient air flow through the radiator 26 to achieve the desired heat transfer. In such cases, the cooling fluid is not cooled to a desired temperature. A temperature sensor 40 monitors the temperature of the cooling fluid. The temperature sensor 40 generates a temperature signal that is sent to a controller 42. If the cooling fluid temperature rises above a predetermined threshold, the controller 42 switches on the cross-flow fan 28 and axial blower 30 to induce supplemental air flow through the radiator 26. Otherwise, the controller switches off the cross-flow fan 28 and axial blower 30.

The axial blower 30 is located between the radiator 26 and the engine 14. The axial blower 30 includes a conventional fan used in automotive applications that rotates to induce air flow. As the fan rotates air is drawn along a longitudinal axis A. The air is drawn through the radiator 26 and the axial blower 30 and flows toward the engine 14. In this way, the axial blower 30 induces air flow through the radiator 26 to draw heat from the radiator 26. In addition, the axial blower 30 will direct air over and around the engine 14 to effect cooling though connection.

The cross-flow fan 28 is disposed behind the fascia 20 and positioned so as not to obstruct natural air flow through the vents 24. Thus, during vehicle driving natural air flow flows through to the radiator 26 unobstructed. The cross-flow fan 28 includes a housing, a centrifuged fan 32, located within a fan housing 33 having an outlet 34. The fan rotates to draw air into the cross-flow fan 28 along a lateral axis Y through a vent 38 or plurality of vents 38 located laterally against the radiator 26. The vents 38 enable air to be drawn into the cross-flow fan 28 from the sides of the vehicle 10. The vents 38 can open to atmosphere through the sides of the vehicle 10 or the wheel wells 22. The fan pushes the air through the outlet 34 blowing the air towards the front face of the radiator 26. In this way, the cross-flow fan 28 induces air flow through the radiator 26 to draw heat from the radiator 26.

A flap or moveable baffle 36 is secured to the fan housing by hinge 44 and is pivotable between an open position and a closed position (shown in phantom). In addition, a switch 46 may be employed with the moveable baffle to ? the cross-flow fan 32 when the movable baffle 36 is in the closed position. In the open position, the flap 36 partially obstructs natural air flow through the vents 24 and enables air flow through the outlet 34. In the closed position, the flap 30 obstructs air flow through the outlet 34 and enables full natural air flow through the vents 24.

Preferably, movement of the flap 36 between the open and closed positions is based on the natural air flow through the vents 24. More specifically, as the vehicle 10 increases speed the natural air flow through the vents correspondingly increases. The increased natural air flow urges the flap 36 toward the closed position against the biasing force of the biasing mechanism 44. Thus, natural air flows unobstructed through the radiator 26. Although the outlet 34 of the cross-flow fan 28 is blocked, supplemental air flow is not needed with the increased natural air flow.

The description of the invention is merely exemplary in nature and, thus, variations that do not depart from the gist of the invention are intended to be within the scope of the invention. Such variations are not to be regarded as a departure from the spirit and scope of the invention.

what is claimed is:

1. A cooling unit comprising:

a radiator having a front face and a back face;

a first fan assembly disposed adjacent said front face, said first fan assembly having a cross-flow fan drawing air from an inlet located laterally adjacent said radiator and directing said air at said front face; and a second fan assembly disposed adjacent said back face, said second fan assembly having an axial-flow fan drawing air through said radiator from said front face to said back face.

2. The cooling unit of claim 1 wherein said first fan assembly further comprises a moveable baffle positionable between an open position to enable air flow from said cross-flow fan and a closed position to block air flow from said cross-flow fan.

3. The cooling unit of claim 2 further comprising a biasing member to bias said movable baffle in said open position.

4. The cooling unit of claim 2 wherein said cross-flow fan is disable when said moveable baffle is in said closed position.

5. The cooling unit of claim 2 wherein said moveable baffle partially blocks a natural air flow into said radiator when in said open position.

6. The cooling unit of claim 1 wherein said radiator further comprises a cooling fluid circuit having an inlet, an interior volume and an outlet, a cooling fluid flowing through said interior volume.

7. The cooling unit of claim 1 further comprising a controller in communication with said cross-flow fan and said axial-flow fan, said controller operable to selectively activate said cross-flow fan and said axial-flow fan.

8. The cooling unit of claim 7 wherein said controller selectively activates said cross-flow fan and said axial-flow fan as a function of a cooling fluid flowing through said radiator.

9. The cooling unit of claim 8 further comprising a thermocouple in communication with said controller and measuring the temperature of said cooling fluid.

10. A cooling unit comprising:

a radiator having an interior volume, an inlet in fluid communication with said interior volume, an outlet in fluid communication with said interior volume, a front face and a back face;

a first fan a assembly disposed adjacent said front face of said radiator, said first fan assembly including:

a fan housing having a first end located laterally adjacent said radiator, a side wall extending transversely long said front face, an inlet formed in said first end and an outlet formed in said side wall;

a centrifugal fan located within said fan housing to draw air into said fan housing through said inlet and discharge air out from said outlet towards said front face; and a moveable baffle connected to said fan housing and positionable between a closed position to cover said outlet and an open position to expose said outlet;

a second fan assembly disposed adjacent said back face of said radiator and including an axial-flow fan drawing air through said radiator from said front face to said back face; and a controller in communication with said centrifugal fan and said axial-flow fan, said controller operable to selectively activate said cross-flow fan and said axial-flow fan.

11. A motor vehicle comprising:

a vehicle body having a front facia with a plurality of vents formed therein;

a engine having a cooling fluid circulating therethrough;

a radiator interposed between said front facia and said engine and aligned with said plurality of vents, said radiator having conduits providing a fluid communication path for said cooling fluid between said engine and an interior volume of said radiator;

a first fan assembly interposed between said front facia and said radiator, said first fan assembly having a cross-flow fan drawing air from an inlet located in said vehicle body laterally adjacent said radiator and directing air out from an outlet toward a front face of said radiator; and a second fan assembly interposed between said radiator and said engine, said second fan assembly having an axial-flow fan drawing air through said radiator;

wherein air flow through said radiator extracts heat from said cooling fluid flowing through said interior volume.

12. The motor vehicle of claim 11 wherein said first fan assembly further comprises a moveable baffle positionable between an open position to enable air flow from said cross-flow fan and a closed position to block air flow from said cross-flow fan.

13. The motor vehicle of claim 12 further comprising a hinge assembly coupling said moveable baffle to said fan housing.

14. The motor vehicle of claim 12 further comprising a biasing member to bias said movable baffle in said open position.

15. The motor vehicle of claim 14 wherein said cross-flow fan is disable when said moveable baffle is in said closed position.

16. The motor vehicle of claim 12 wherein said moveable baffle partially blocks a natural air flow into said radiator when in said open position.

17. The motor vehicle of claim 11 wherein said radiator further comprises a cooling fluid circuit having an inlet, an interior volume and an outlet, a cooling fluid flowing through said interior volume.

18. The motor vehicle of claim 11 further comprising a controller in communication with said cross-flow fan and said axial-flow fan, said controller operable to selectively activate said cross-flow fan and said axial-flow fan.

19. The motor vehicle of claim 18 wherein said controller selectively activates said cross-flow fan and said axial-flow fan as a function of a cooling fluid flowing through said radiator.

20. The motor vehicle of claim 19 further comprising a thermocouple in communication with said controller and measuring the temperature of said cooling fluid.

* * * * *